US005402814A

United States Patent [19]

Odom

[11] Patent Number: 5,402,814

[45] Date of Patent: Apr. 4, 1995

[54] HOSE STORAGE AND REEL ASSEMBLY AND METHOD

[76] Inventor: Bennie Odom, P.O. Box 499, Conroe, Tex. 77305

[21] Appl. No.: 240,338

[22] Filed: May 10, 1994

Related U.S. Application Data

[63] Continuation of Ser. No. 132,639, Oct. 6, 1993, Pat. No. 5,335,687.

[51] Int. Cl.[6] ..... F16L 55/18; B65H 75/36

[52] U.S. Cl. ..... 137/15; 137/355.26; 242/398; 242/407.1

[58] Field of Search ..... 137/15, 355.26; 242/397, 398, 407.1

[56] References Cited

U.S. PATENT DOCUMENTS

| | | |
|---|---|---|
| 2,299,521 | 10/1942 | Zierden . |
| 2,300,243 | 10/1942 | Zierden . |
| 2,334,141 | 11/1943 | Zierden . |
| 2,911,996 | 11/1959 | Kollmann . |
| 2,989,980 | 6/1961 | Cullen et al. . |
| 3,384,140 | 5/1968 | Brothers . |
| 3,776,262 | 12/1973 | Fritsch . |
| 3,804,111 | 4/1974 | Chatard et al. . |
| 4,283,010 | 8/1981 | Arzi et al. . |
| 4,330,005 | 5/1982 | Kjarsgaard . |
| 4,537,215 | 8/1985 | Roman . |
| 4,588,083 | 5/1986 | Hunt . |
| 4,984,685 | 1/1991 | Douglas . |
| 5,056,731 | 10/1991 | Koehn . |
| 5,103,977 | 4/1992 | Douglas . |

*Primary Examiner*—A. Michael Chambers
*Attorney, Agent, or Firm*—Browning, Bushman, Anderson & Brookhart

[57] ABSTRACT

A reel assembly for storing, coiling, and decoiling a flexible elongate member, such as a water hose, includes a stationary base and an enclosure rotatably mounted relative to the stationary base. The hose enclosure is designed such that the coiled hose can be removed from the receiving cavity and a new flexible elongate member positioned within the receiving cavity. The enclosure is also constructed so that the assembly be easily altered from a usable configuration to a storage/shipment configuration. Fluid may be transmitted through a center support member of the reel assembly to a coiled hose within the receiving cavity. According to the method of the present invention, the user pulls outward on the hose to rotate the enclosure relative to the base and thereby withdraw the hose from the assembly, and thereafter pushes the hose toward the assembly to rotate the enclosure in the opposite direction and thereby recoil the hose within the assembly.

20 Claims, 2 Drawing Sheets

HOSE STORAGE AND REEL ASSEMBLY AND METHOD

This is a continuation of application Ser. No. 08/132,639, filed Oct. 6, 1993, now U.S. Pat. No. 5,335,687, issued Aug. 9, 1994.

FIELD OF THE INVENTION

The present invention relates to an assembly for storing and coiling elongate flexible members, and more particularly relates to a portable reel assembly both for storing a water hose or similar elongate member, and for assisting in easily hose decoiling or unwinding from the reel assembly and recoiling or rewinding the hose in a coil within the reel assembly.

BACKGROUND OF THE INVENTION

Various devices have been used for winding elongate flexible members, such as wire, rope, hose, tubing, or electrical cord, within a reel assembly, so that the flexible member can be more easily stored. By properly storing such an elongate member, kinks and twists in the flexible member are minimized, thereby minimizing difficulties encountered when unwinding the flexible member from the reel assembly for subsequent use. Also, many flexible members serving as electrical or fluid transmitters cannot efficiently serve their intended purpose after the flexible member has been repeatably kinked. Most individuals have experienced difficulty when winding or transporting conventional water hoses or electrical cords, and can thus appreciate the advantages of an easily operable device to assist in coiling, decoiling and storing the water hose; or the electrical cord.

Some previously devised units are relatively simple storage devices which form a container for receiving the elongate member in a coil, so that the container facilitates the shipment and storage of the hose or other elongate member. Such relatively simple storage devices may not, be designed to rotate, or, may not be intended to facilitate either the winding of the flexible elongate member into the assembly, or the decoiling or unwinding of the elongate member from the assembly. Typical prior art storage containers for elongate members are disclosed in U.S. Pat. Nos. 3,384,140, 3,776,262, and 4,330,005. U.S. Pat. Nos. 2,911,996 and 4,588,083 disclose water hose containers which do not significantly assist in winding the hose within the reel assembly or in removing the hose from the reel assembly.

Various other reel assemblies are specifically adapted and can practically be used for only one type of elongate flexible member. U.S. Pat. Nos. 2,989,980 and 3,804,111 are each directed to a complex and expensive assembly for storing flexible tubing used in oil recovery operations. U.S. Pat. No. 4,283,010 discloses a hose container primarily intended for large-scale irrigation purposes. U.S. Pat. Nos. 4,984,685 and 5,103,977 each disclose an assembly which is adapted for storing electrical cords or lines. U.S. Pat. No. 5,056,731 is directed to a reel and storage container for a fishtape. The .cost of the reel assembly can be substantially reduced if a reel assembly is adapted for use with more than one type of elongate flexible member, and the practical benefits of the device to the user are enhanced if the device has the multi-purpose capability of being used to easily coiling, decoiling, and storing numerous types of elongate flexible members.

Various equipment has been devised for storing flexible water hoses which are commonly used for lawn or garden watering, or are used to connect a recreational vehicle to an adjacent water outlet. Many of these prior devices are particularly suited for stationary applications. U.S. Pat. No. 2,334,141 discloses a hose reel which is adapted to be secured to the exterior wall of a house or building. Another version of fixed installation reel assembly is disclosed in U.S. Pat. No. 2,299,521. The assembly described in the latter patent includes a stationary guide for facilitating rewinding the hose onto the rotatable reel.

Other hose reel assemblies do not allow the coiled hose to be removed from the reel assembly for storage at another location, or are not designed to prevent a section of coiled hose from "jumping out" or coming up out of the assembly in a manner which will cause undesirable twisting or kinking of the hose. U.S. Pat. No. 2,300,243 discloses a reel assembly with a rotatable reel, but the wound hose cannot be easily separated from or replaced on the reel. U.S. Pat. No. 2,911,996 discloses a portable water hose storage unit, but the assembly is both bulky and presumably difficult to use, does not rotate to assist in coiling or decoiling, and allows a wrap of stiff coiled hose to jump out of the assembly. U.S. Pat. No. 4,537,215 discloses an assembly for coiling a water hose, but the assembly requires that the hose exit through a slot of a particular location, and the assembly does not allow the coiled hose to be easily removed.

Prior art reel assemblies accordingly have one or more problems or characteristics which have limited their acceptance by many potential users. As indicated above, some of these devices are not portable for use at various locations, while other devices are intended for use with only a particular type of elongate member, such as an electrical cord, and cannot be used for a water hose or other elongate member. Some reel assemblies can accommodate the intended flexible elongate member, but a fitting, nozzle, or other device attached to the discharge end of the elongate member cannot fit within the reel assembly, so that these end attachments necessarily are susceptible to damage while remaining attached to the elongate member and thus stored external of the reel assembly. Other prior art devices are functionally intended merely for storage, and do not assist in unwinding the hose or other elongate member from the reel, or in rewinding the hose within the reel assembly. Some units employ a spring which may be biased to assist in winding, but which complicate the structure of the reel assembly and increase the cost of the assembly. Some biased reel storage assemblies require that the elongate flexible member be wound on the reel in a certain direction, e.g., clockwise, and that the flexible member accordingly be unwound from the reel assembly in the opposite direction. Other reel assemblies perform reasonably well under ideal temperature conditions, but do not work satisfactorily when winding a hose or other elongate plastic member which is cold and thus more rigid. Many prior art reel assemblies are bulky, and cannot be easily shipped and quickly used by the purchaser.

The disadvantages of the prior art are overcome by the present invention, and an improved reel assembly is hereinafter disclosed which is suitable for storing the plurality of elongate tubular members, and is particularly well suited for both storing and coiling/decoiling a flexible elongate member which serves as a fluid, vacuum, or electrical transmitter, such as a water hose.

The reel assembly of the present invention also substantially assists in winding the hose in a coil within the reel, and facilitates the easy unwinding of the hose from the reel with minimal hose kinking or twisting.

SUMMARY OF THE INVENTION

In a suitable embodiment, the reel assembly of the present invention comprises a base, which remains stationary when a water hose is unwound from the reel assembly or wound within the reel assembly, although the base need not be bolted or otherwise fastened down to remain stationary. The reel assembly is, however, relatively lightweight and compact, and thus can be easily transported and manipulated to different locations by the user. An inner wall, an outer wall, and an enclosure base form a coiled hose receiving cavity, and are rotatably mounted on the base by one or more beating members or assemblies. At the top of the hose enclosure, a stationary arm projects substantially between the inner wall and an inwardly directed plate attached to the outer wail, and effectively prevents the hose from inadvertently coming out of the hose receiving cavity, i.e., unless the hose enclosure is rotated about the base. The arm may, however, also allow the coiled hose to be lifted out of and removed from the hose receiving cavity, and a new coiled hose or other desired elongate flexible member positioned within the receiving cavity so that the reel assembly may be reused.

The enclosure forming the receiving cavity rotates with respect to the base when an operator pulls on the hose, thereby discharging hose from the receiving cavity within the reel assembly. Similarly, the operator merely pushes the hose toward the reel assembly in order to rotate the hose enclosure in the opposite direction and thereby rewind the hose within the receiving cavity. Hose end attachments may be safely positioned within the receiving cavity for storage with the hose. A swivel mechanism may be provided for connecting a reel supply line to both a source and a center support member secured to the stationary base, so that a supply line does not interfere with the normal operation or use of the reel assembly.

The hose reel assembly of the present invention may be generally fabricated from a plastic material, so that the assembly is corrosion resistant, lightweight, relatively inexpensive, and has a comparatively long life. The assembly is collapsible for reduced size during shipment, but may be easily assembled for use by a comparatively inexperienced purchaser. A hose or other flexible member may be wound within the receiving cavity in the direction desired by the user, and the wound coil may be removed from the receiving cavity for storage at a location separate from the reel assembly. A coil of a similar elongate member or a coil of another type of flexible elongate member may then be installed within the enclosure, and the reel assembly again thereafter selectively activated for both unwinding and rewinding the new flexible elongate member within the reel assembly.

It is an object of the present invention to provide an improved reel assembly for storing a flexible elongate member in a coil, and for assisting in the coiling and decoiling of the elongate member from the reel assembly and in the rewinding of the elongate member in a coil within the reel assembly.

It is a further object of the present invention to provide improved reel assembly wherein the elongate member is wound in a coil within the assembly, the elongate member is pulled by the operator to unwind the elongate member from the reel assembly, and the elongate member thereafter may be pushed by the operator to rewind the elongate member in a coil within the reel assembly.

A significant feature of the present invention is that the device may be lightweight and highly portable, so that the assembly may be used as desired by the operator at various locations.

A further feature of the present invention is that a rigid crossbar or arm is provided at the upper end of the enclosure for preventing the coiled elongate member within the receiving cavity from inadvertently coming out of the cavity, i.e., unless the enclosure is rotated with respect to the base, or the hose is removed as a coil from the enclosure.

Yet another feature of the present invention is that the device may be used for winding, storing; and unwinding various elongate flexible members, such as wire, rope, hose, electrical cord, or flexible conduit. Accordingly, a coiled elongate member may be easily removed from the reel assembly, and a similar or dissimilar elongate member then installed within the reel assembly in a coil. The device may thus practically be used with various types of elongate flexible members.

Still another feature of this invention is that the assembly may be used to simultaneously store multiple elongate flexible members, such as a water hose, an air hose, and an electric cord. An input water supply line thus may remain connected to the water hose positioned within the assembly, while the assembly simultaneously may be used to uncoil and recoil the air hose or the electric cord also stored within the assembly.

An advantage of the present invention is that an operator may decide to wind an elongate member in either direction within the reel assembly. Biasing members are not required to easily unwind the elongate member from the reel assembly or to rewind the elongate member within the reel assembly, thereby enhancing the useful life of the assembly.

Another advantage of the present invention is that the device may be positioned at a reduced size so that the device may be easily stored or shipped, and the device may also be quickly and easily assembled for its intended use by the operator.

Yet another advantage of the invention is that the device is constructed such that kinking and twisting of the elongate member is minimized during use of the assembly, thereby practically extending the useful life of the elongate flexible member.

Still another advantage of the invention is that most fittings mounted at the free or discharge end of the elongate member may be easily stored within the enclosure along with the coiled elongate member. Such fittings or other related items may also be disconnected from the elongate flexible member yet conveniently stored within the assembly.

These and further objects, features, and advantages of the present invention will become apparent from the following detailed description, wherein reference is made to the figures in the accompanying drawings.

BRIEF DESCRIPTION OF THE DRAWINGS

FIG. 1 is a cross-sectional view of a suitable reel assembly according to the present invention. The left side of the assembly as shown in FIG. 1 is structurally substantially identical to, the right side of the assembly, although the left side of. FIG. 1, depicts the assembly arranged for its normal intended use, while the right side depicts the same assembly in a reduced size for storage or shipment.

DETAILED DESCRIPTION OF PREFERRED EMBODIMENTS

Figure 1:
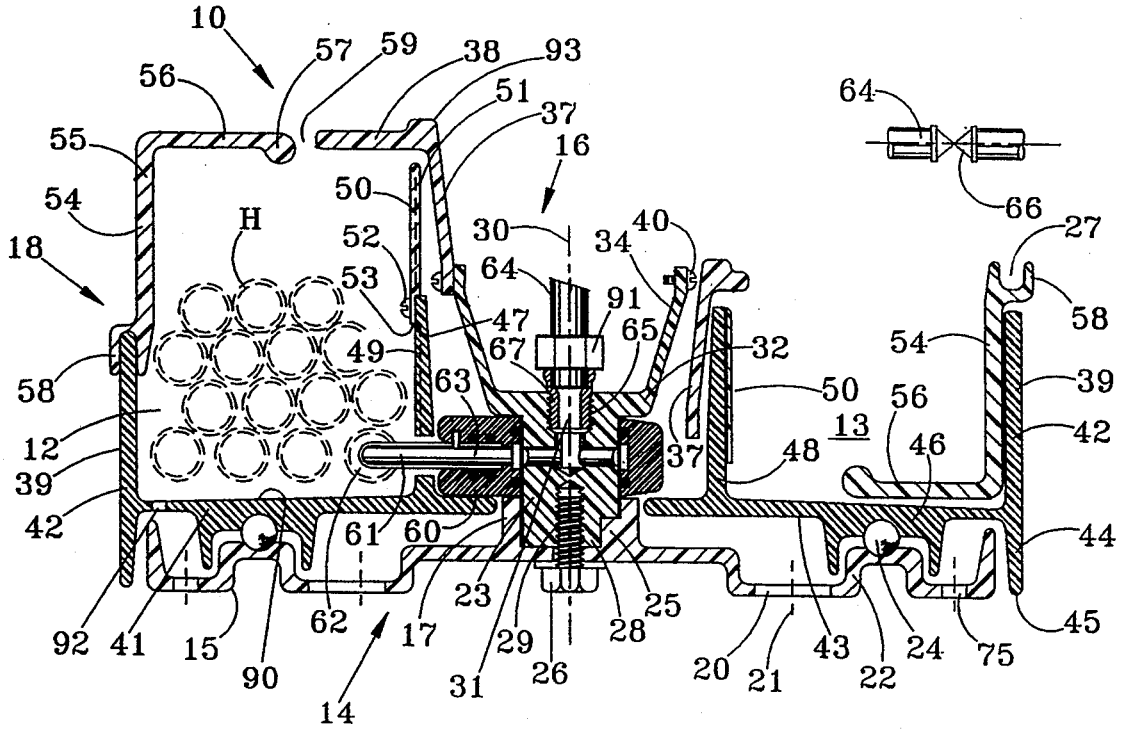

FIG. 1 generally depicts a reel assembly 10 according to the present invention. For explanation purposes, the reel assembly 10 will be described for storing a coiled water hose H. Those skilled in the art will understand that assembly 10 may be used for storing other elongate flexible members. Also, the assembly 10 is designed and constructed so that relatively minor modifications to the assembly may be made so that the assembly may be used with other types of elongate flexible members, such as vacuum lines, gas hose, or electrical cords, which transmit or conduct energy and/or material through the elongate flexible member. Also for purposes of explanation, the assembly 10 is presumed to be used while its base is resting on a relatively flat horizontal surface, although again the device or assembly could be easily used while either resting on or being supported from various slanted or vertical surfaces.

Referring to the left side of the centerline 30 in FIG. 1, the assembly 10 includes a center support member 16 extending upwardly from and fixed to base member 14 by bolt 26. Hose enclosure 18 comprises a lower enclosure member 42, a ring-shaped upper exterior enclosure member 55, and a sleeve-shaped upper interior enclosure member 50. The lower enclosure member 42 comprises an enclosure base member 41, a lower radially outward wall member 39 and a lower radially inward wall member 48, each lower wall member being fixedly secured to and preferably integrally forward with the enclosure base member 41. The members 39 and 48 form respective lower portions of a radially outer and radially inner wall member, with each lower portion cooperating with upper wall portions 55 and 50, respectively. Hose enclosure 18 thus forms a donut-shaped hose receiving cavity 12, which has a generally rectangular cross-sectional configuration as shown on the left side of centerline 30. It should be understood that during use, the fight of assembly 10 is structurally identical to the left side, except as explained below. When in use, the assembly 10 thus has a generally upright cylindrical configuration. The disk-shaped base 14 may be molded from any selected plastic. The base 14 may typically have a diameter of approximately 35 centimeters (14 inches) inches, and may be generally similar to the base of the toy described in U.S. Pat. No. 3,873,087. The size of the enclosure 18 which forms the receiving cavity 12 for the coiled hose H and the height of base 14 thus defines the height of the upright cylindrical configuration of the assembly 10, which in use may be approximately 20 centimeters (8 inches) high.

According to a preferred embodiment, the lower enclosure member 42 is rotatably mounted on the base 14 and thus is rotatable about center support member 16 both during use and storage/shipment of the assembly 10. When the assembly 10 is in use, the upper exterior enclosure member or upper outer wall portion 55 and the upper interior enclosure member or upper inner wall portion 50 are each fixedly supported on and thus rotate with the lower member 42. During use, a lower support surface 53 on member 50 rests on a corresponding upper support surface 47 on the sleeve-shaped support 48 of the lower member 42. In order to reduce the size of the assembly 10 for storage/shipment as shown to the right of centerline 30 in FIG. 1, bolts, screws, or other conventional securing members 52 may be unfastened, so that the sleeve shaped member 50 may thereafter be rotated until elongate key-like portions 51 on the interior surface of member 50 are aligned with corresponding vertical slots or keyways 49 on the outer generally cylindrical surface of the support 48, thereby allowing member 50 to slide down along 48 and within the cavity 13, as shown on the right side of FIG. 1, for reduced size of the assembly when in a storage/shipment configuration.

During use, the upper exterior closure member 55 includes a sleeve-shaped substantially vertical wall member 54, and a generally horizontal, radially inwardly projecting and ring-shaped upper plate 56 fixedly secured to and preferably integrally formed with wall member 54. The wall member 54 and plate 56 in cross-section have an inverted L-shaped configuration, as shown on the left side of FIG. 1. The securing end of a upper exterior closure member 55 may have a lower shoulder ring 58 with a downwardly projecting slot 27 for snapping the member 55 in place on the upper edge of the exterior wall member 39 of the lower enclosure member 42. During use of the assembly 10 as explained hereafter, plate member 56 cooperates with an arm 38 to prevent the hose from "jumping out" or coming up out of the hose receiving cavity 12. If desired, the radially inward edge of the plate 56 may have a lip portion 57 thereon to provide the desired strength and rigidity to the member 55, to serve as a grasping "handle" when removing member 55 from (or reinstalling member 55 on) the lower member 42, and to further assist in preventing the hose H from coming up out of the receiving cavity 12.

For storage/shipment, member 55 is detached from the sleeve-shaped wall member 39, and is inverted so that the plate 56 is below wall 54, as shown to the right of centerline 30. The dimensions and tapers on the components 55 and 39 are thus controlled so that the member 55 may substantially fit within the shortened receiving cavity 13 formed by the lower enclosure member 42. Those skilled in the art of injection molding techniques will also appreciate that the dimensions and tapers of members 50 and 48 are also controlled to facilitate the "twist and drop" and "twist, pull, and lock" operations described herein for selectively altering the assembly from a use configuration to a storage/shipment configuration for the components for the assembly 10.

The lower enclosure member 42 thus has a generally U-shaped cross-sectional configuration, within an outer lower wall portion 39 and the inner lower wall portion 48 being spaced apart and supported on the enclosure base 41 to form the desired shortened receiving cavity 13. A downwardly projecting ring member 46 on lower enclosure member 42 cooperates with an upwardly projecting ring member 22 on base 14, so that bearing members, generally depicted by balls 24, facilitate relatively low frictional rotation of the hose enclosure 18 about the base 14. The ring shaped member 46 and the bearing members 24 may be similar to the corresponding members generally depicted in U.S. Pat. No. 3,873,087. If desired, the base 14 may include a plurality generally circular through ports 20 each formed about a respective axis 21. Those skilled in the art will appreciate that various modifications to the base 14 and the lower member 42 may be made to accommodate more refined and thus lower friction bearing assemblies 24. Also, surface modifications to the base 14 and a lower surface of member 42 may be made, e.g., by graphite impregnation or Teflon coating operations, so that these surfaces effectively serve as bearing members to achieve the desired easy rotation of the hose enclosure 18 on base 14 about centerline 30.

Lower enclosure member 42 may also include a radially outer ring-shaped and downwardly projecting member 44 extending below lower surface 43 of enclosure base 41 for generally enclosing the assembly base 14. It should be understood that the terminal end 45 of the ring-shaped member 44 terminates above the supporting surface 15 of the base 14 which engages the ground or other generally horizontal support surface, since the entire unitary member 42 rotates during use about the base 14 when the assembly 10 is positioned on a horizontal surface. If desired, a number of friction pads or similar devices may be attached to the lower surface of the base 14 to prevent undesirable rotation of the base when the assembly 10 is in use, although generally such friction pads should not be required when the assembly is used on most horizontal surfaces.

The center support member 16 comprises a lower body or post 28 having an upper cylindrical portion 23, a lower portion having one or more vertical locking slots for receiving key portion 25 of base 14, and a threaded pocket 29 for receiving bolt 26. An upper shoulder plate portion 32 has a diameter greater than the diameter of the cylindrical body 28. A plurality of locking slots, typically 3 or 4, may be provided within the lower portion of post 28 each for receiving a respective key portion 25 of base 14, although for simplicity of illustration only one key portion 25 is shown in FIG. 1. The locking slots and key portions prevent rotation of the center support member 16 about base 14, with bolt 26 serving to prevent unintentional separation of member 16 and base 14.

A generally cup shaped body 34 is integrally formed with and is supported on the plate portion 32. An upper center member 37 is removably supported on body 34 by conventional securing members 40, such as bolts or screws. Member 37 is slightly tapered as shown in FIG. 1 to allow the member 37 to drop between 48 and 34, as shown to the right of centerline 30 in FIG. 1, when the securing members 40 fire removed. The member 37 thus effectively has a configuration which defines an apex point (not shown) substantially aligned with centerline 30 and spaced below the securing members 40. The arm 38 is fixed to and preferably integrally formed with member 37, and arm 38 has a configuration discussed subsequently. The arm 38 extends radially outward of the rotatable sleeve member 50, and thus substantially closes the gap 59 which otherwise would exist between the lip portion 57 and the center support member 16. As shown in FIG. 1, this gap 59 has a width which preferably is less than (or less preferably as least not substantially greater than) the diameter of the flexible elongate member, such as hose H.

A desirable feature of this invention is that assembly 10 is designed and constructed such that a flexible conduit, such as a hose or electrical line, may feed supply (whether water, air, other gases, liquids, fluid, or electrical current) to the assembly 10 without interfering with the operation of the assembly." A supply conduit on supply line 64 having a valve or switch 66 is shown schematically in FIG. 1. For purposes of this example, the line 64 is shown having a standard hose threaded end 67. The cylindrical body 28 and plate portion 32 may thus include a corresponding threaded pocket 65, which may be easily modifiable to receive the standard end fittings normally provided on line 64 or on the supply line of various fluid or other transmitting lines. In a typical application, the user may utilize a short length of flexible water hose for line 64, and may thread the standard downstream fitting 67 to the pocket 65 provided in the center support member 16, as shown in FIG. 1. With the line 64 attached to the assembly 10 and with the hose H already coiled within the cavity 12, the user may then carry the assembly 10 from a temporarily stored location to a place where the assembly 10 will be used. When the user reaches the desired location, the assembly 10 may be placed on the ground (or other substantially horizontal surface), and the corresponding standard hose fitting (not shown) at the upstream end of the line 64 may be directly connected to the valve 66. For purposes of this example, the valve 66 may be a standard valve provided on the side of a house, or may be the valve commonly provided at recreational sites to provide pressurized water to RV users.

FIG. 1 also depicts components which allow water to be supplied to the hose H while the enclosure 18 rotates about the base 14 and thus about the center support member 16. The post 28 is shown to include a fluid passageway 31 to discharge water to rotatable ring member 60. In a preferred embodiment, the passageway 31 may be formed with a center vertical cavity, and a plurality of radial passageways each extending outward from a lower end of the vertical cavity. Each of the outwardly extending cavities may be machined or otherwise formed at selected locations along the outer surface of the post 28 to communicate with the vertical cavity 31. Details relating to the ring member 60 are discussed subsequently, although it should be understood from FIG. 1 that an L-shaped metal conduit 61 has been provided with an upstream end 63 for forming a sealed connection with the ring member 60. The downstream end of the L-shaped conduit 61 has a standard fitting, generally depicted at 62, for connection with the standard upstream end of the water hose H.

It may also be seen in FIG. 1 that the base 14 includes an upwardly projecting support 17 having a cylindrical cavity therein for receiving the post 28. Since the bolt or either securing member 26 fixedly secures the center support member 16 to the base 14, the cam lock ring member 60 is effectively sandwiched between the upper surface on the center support 17 and a lower surface on the plate member 32, although the ring member 60 is free to rotate about post 28 in response to driving rotation of conduit 61 by an operator, as described subsequently. Also, it should be understood that the inner surface of post 28 be fabricated to provide a reliable sealing surface for the ring member 60, while also facilitating relatively easy rotation of the ring member 60 and thus the enclosure 18 with respect to the base 14.

Figure 2:
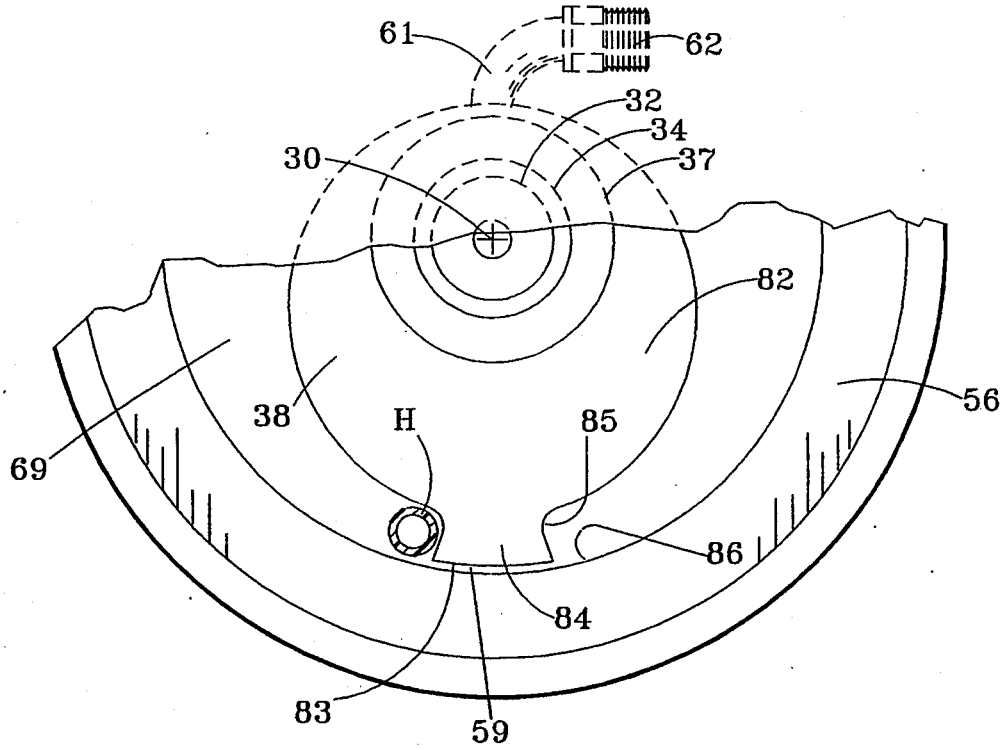
FIG. 2 is a simplified top view of a portion of the assembly shown in FIG. 1.

FIG. 2 depicts a top view of certain components of the assembly 10 shown in FIG. 1. The L-shaped conduit 61 and fitting 62 for interconnecting the hose H and the center support member 16 were previously described. FIG. 2 depicts a suitable configuration for the member 37, and particularly for the arm 38. As previously noted, the function of the arm 38 as shown in FIG. 1 is to act as a stop or bar to prevent a coil of hose H from coming up out of the receiving cavity 12. For the depicted embodiment, the arm 38 consists of portion 82 and extension ear 84. Each side of the ear 84 may be provided with a curvilinear surface 85 for engagement with the elongate member, such as hose H. As shown in FIGS. 1 and 2, a slight gap 59 exists between the radially outer end surface 83 on the ear 84 and the radially inner surface 86 on the ring-shaped plate member 56. The gap 59 between surfaces 83 and 86 preferably does not allow a coil of the elongate tubular member within the cavity 12 from passing between the center support member 16 and the rotatable enclosure 18.

Referring now to FIGS. 1 and 2, the operation of the assembly 10 will now be further described. For purposes of this explanation, it is assumed that a short length of hose 64 has already been connected to the center support member 16 and also to the flow line including the valve 66. When the user desires to extend the hose, he or she merely reaches through the sizeable gap 69 which exists between the center support member 16 and the plate 56 at the location generally radially opposite ear 84, and grasps the end of the hose H and/or the hose spray nozzle, valve, or other suitable discharge mechanism mounted on the end of the hose H. As the user either walks away from the assembly 10 or remains substantially stationary while pulling the hose H out of the cavity 12, the hose uncoils as it is withdrawn from the assembly. Typically the hose H will coil within and uncoil from the assembly 10 without engaging the arm 38, although the hose H may be pulled out at an angle which will cause the hose H to engage the arm 38. In either event, continued pulling of the hose will thereafter cause the entirety of the enclosure 18 to rotate with respect to the base 14 and thus with respect to the stationary arm 38 on the center support member 16. In general, the hose will wrap around the radially inward member 48 during this uncoiling operation, forcing the member 42 to rotate. The enclosure 18 will continue to rotate in this manner, until the selected length of hose H has been withdrawn, or until further rotation of enclosure 18 is prohibited because no further length of coiled hose remains within the cavity 12. If the valve 66 is closed during the above-described process, the user may then connect the discharge end of the hose H to a desired mechanism. For the example previously described, the user in fact may leave valve 66 open during the hose unwrapping process, so that the user selectively may actuate a spray nozzle (not shown) at the discharge end of the hose H while simultaneously pulling the hose H from the assembly 10.

A significant advantage of the present invention relates to the ease of which the user may recoil the hose H within the cavity 12. To perform this operation, the user may typically stand adjacent the assembly 10, with the hose H extending from the assembly. The user then grasps the hose H at a distance of several inches or more from the assembly 10, and pushes the hose slightly downward and into the cavity 12. The enclosure 18 rotates as the hose is inserted, and desirably initially fills the outer portion of the cavity 12. When recoiling the hose within the assembly, the hose again may (but need not) slidably engage the arm 38. Once the discharge end of the hose is adjacent the user, the user may simply continue pushing the hose H into the cavity 12, then grab the valve, spray nozzle, or other member at the discharge end of hose H, and place the discharge member within the cavity 12 for protection with the hose. Assembly 10 may be left in place until it is subsequently used or, if desired, the short hose 64 may be removed from the valve 66, the short hose optionally stored with the hose H within the cavity 12, and the assembly 10 temporarily stored in its useable configuration.

By desirably recoiling the hose H first around the outer wall 39 of the rotatable container 18 rather than around the hub of a spool (which normally would correspond to the diameter of the members 48 and 50), the elongate flexible member is not unnecessarily bent in a sharp radius. As previously noted, the assembly 10 of the present invention in fact minimizes kinking and twisting of the elongate flexible member, thereby prolonging its life. It should also be noted that when the user uncoils the flexible elongate member from the assembly 10 or when the user is recoiling the elongate member within the assembly 10, the user may stand at any desirable position relative to the assembly 10, thereby again enhancing the versatility of the assembly and ease with which the device may be operated. During both coiling and decoiling of the flexible elongate member, the likelihood of any significant backlash is minimal or non-existent.

A coil of elongate flexible member may be wound in either the clockwise or counterclockwise direction within the cavity 12. Normally, the elongate flexible member will be wound in the direction suggested by the position of the fitting 62 relative to the conduit 61 and the axis 30. It should be noted that the user may also flip over and reinstall the ring member 60 on the post 28 so that the fitting 62 (see FIG. 2) will project to the left rather than to the fight when the conduit 61 is locked to the ring member 60, thereby facilitating coiling of the elongate flexible member within the cavity 12 in the opposite rotational direction. Those skilled in the art will understand that another elongate flexible member, such as a vacuum hose, air or other type of gas hose, liquid hose, or an electrical cord, may have a discharge or end member, such as a suction head, an air nozzle, or a light bulb attached thereto. In either case, the end of the flexible elongate member and the discharge fitting or device may be safely stored within the assembly 10.

Figure 3:
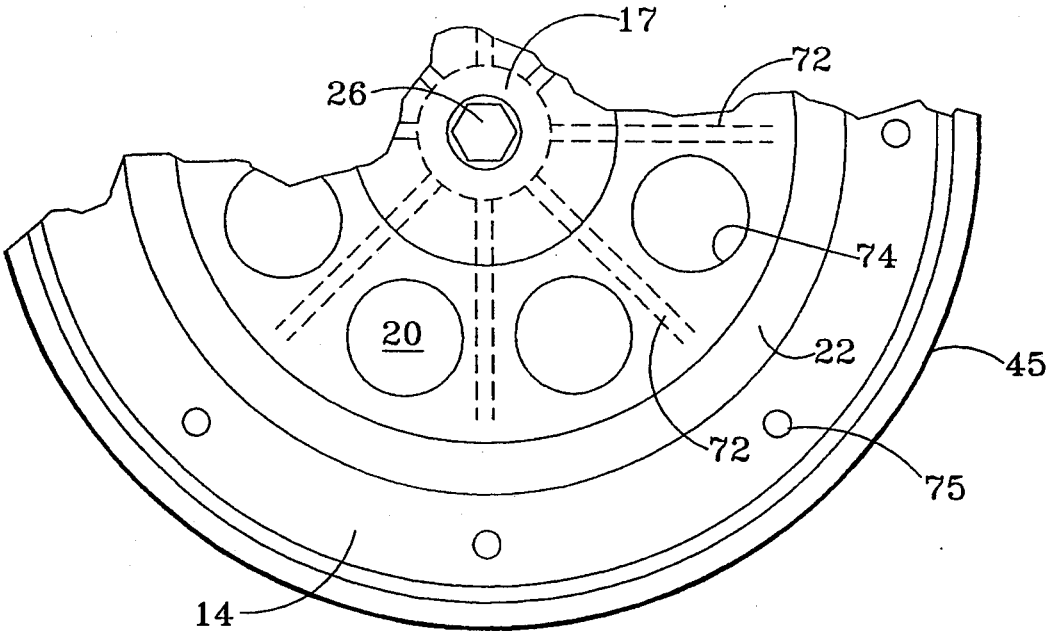
FIG. 3 is a simplified bottom view of a portion of the assembly shown in FIG. 1.

Referring now to FIG. 3, a suitable embodiment of the base 14 may be similar to that disclosed in U.S. Pat. No. 3,873,087. Each of the through ports 20 may have a circular sidewall 74 to reduce material weight, and to allow for liquid (water) drainage from the assembly. A plurality of ribs 72 provide the desired structural connection between the center support 17 and the annular ring 22 for the bearing members 24. (See FIG. 1 ) If desired, a plurality of small diameter apertures 75 may be provided to assist in the process of injection molding the base 14, which also desirably providing liquid drainage from the assembly 10. Similarly the upper surface 90 of member 42 may be slightly tapered as shown in FIG. 1, and ports 92 optionally provide for drainage.

Figure 4:
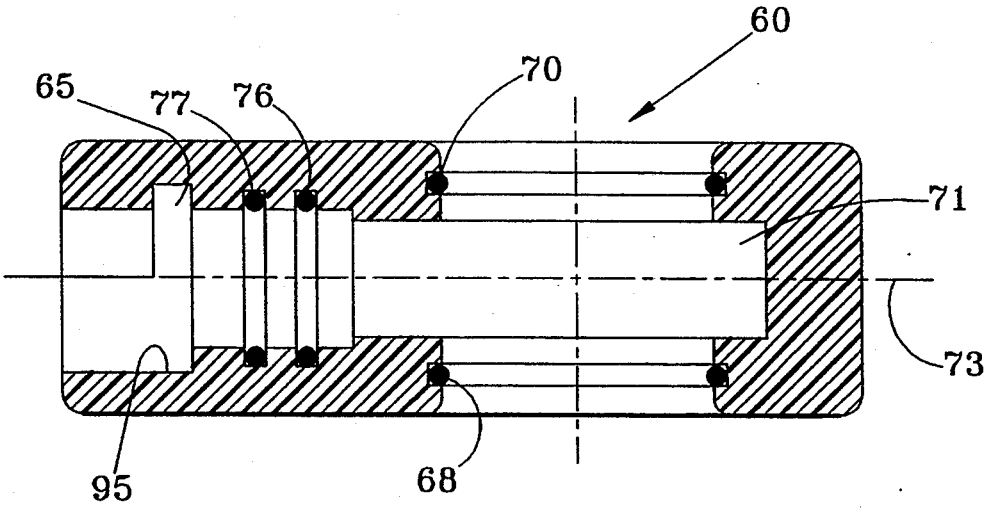
FIG. 4 is a cross-sectional view of a suitable 180° cam lock ring generally shown in FIG. 1.
Figure 5:
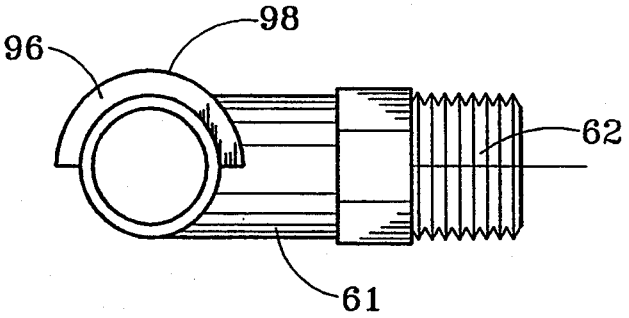
FIG. 5 is an end view of the fluid conduct generally shown in FIG. 1, and illustrates the semi-circular flange for selectively locking the conduit to the cam lock ring.

Referring now to FIGS. 1, 4 and 5, the 180° cam locking ring 60 remains in sealing engagement with the end of the brass conduit 61 opposite the fitting 62, with the metal conduit positioned as shown in FIGS. 1 and 2. While in this assembled and operating position, lower and upper O-rings or other sealing members 68 and 70, respectively, thus seal with the outer exterior surface of the cylindrical body or post 28. The conduit 61 includes a generally semicircular flange 96 fixed to the upstream end 63. When the conduit 61 is rotated so that flange 96 fits within the locking slot 65 in the ring 60, the conduit 61 and ring 60 are connected and in fluid-tight sealing engagement. Thus when the conduit 61 is rotated 180° as described above, the locking edge 98 of the flange 96 as shown in FIG. 5 will be in engagement with the surface 95 or the ring 60. Subsequently, the flange 96 may be rotated so that it is completely out of the slot 65, and then the conduit 61 may be pulled along the axis 73 out of the ring 60.

The annulus formed by cavity 71 is thus in sealing engagement with the supply line 64 shown in FIG. 1. The fluid discharge end of the locking ring 60 has a primary and a backup sealing member 76 and 77, respectively, to maintain corresponding sealed engagement between the brass conduit 61 and the ring member 60. If replacement of the conduit 61 or replacement of the seals 77 and 76 are desired, the conduit may be rotated 180° relative to the axis 73 of the locking ring 60, so that (referring to FIG. 2) the fitting 62 is positioned to the left rather than to the right. A catch or other locking member on the conduit 61 thus rotates within the locking slot 65 provided within locking ring 60. This rotation thus allows the conduit 61 to be pulled out of the ring member 60, the seals 76 and 77 replaced, the conduit 61 reinstalled within locking ring 60, and the conduit 61 rotated 180° (back to the position as shown in FIG. 2), thus effectively locking the conduit 61 to the locking ring 60 while desirably maintaining sealed engagement of these components. The 180° locking ring 60 thus interconnects the rotatable hose H and the stationary center support member 16, and acts as a fluid transfer member to generally accomplish this purpose. Other suitable transfer members may be used to serve this same purpose.

Another feature of the present invention involves the ease with which a coil of elongate member may be removed from the assembly 10, and a similar or a different coil of elongate tubular member placed within the cavity 12. With the assembly 10 sitting on the ground or other generally horizontal surface, the user may simply lift up on the member 55, or alternatively may exert a prying force between members 42 and 58, to easily separate the upper and outer enclosure member 55 from the lower enclosure member 42. The user then may press a coil or two of hose H radially outward with one hand, then disconnect the input end of a connected hose H from the fitting 62. The user may then grab the entire coil, and lift the coil out of cavity 12, turning the coiled hose slightly generally in a direction toward the arm member 38, so that the entire coil of hose H will then be free from the assembly 10. The hose may be temporarily stored in a coil of the same diameter, which allows the coiled hose to be easily reinserted at a later date into the assembly 10. Another coil of elongate member, e.g., a "soaker" hose which was previously stored in the assembly by the user, may then be picked up and easily inserted within the chamber 12 (assuming the coil diameter remained approximately the nominal diameter of the chamber 12). After securing the input end of the new hose to the fitting 62, if desired, the user may merely snap the member 55 back in place on top of member 42, and the assembly 10 with the new hose will then be ready for use. It is a particular feature of the invention that various types of elongate flexible members as described herein may be simultaneously stored within one assembly. The operator may grasp the end of the one coiled member and easily uncoil it from (and recoil it within) the assembly while the other coiled members remain within the assembly.

For purposes of long term storage or shipment (storage/shipment configuration), the assembly 10 may be arranged as shown to the right of centerline 30 in FIG. 1. To rearrange the components so that the assembly 10 in its usable configuration as shown to the left of centerline 30, the user may simply remove member 55 from the reduced chamber 13, then slide the frustroconical member 37 upward with respect to 34 until it may be secured in that position by bolts or screws 40. The sleeve-shaped member 50 may then be slid upward and rotated to a locking position, so that member 50 is supported on member 48. Unintentional rotation of member 50 relative to 48 may thereafter be prohibited by tightening securing members 52. Assembly 10 is then usable after the member 55 has been snapped in place on the member 42. Those skilled in the art will appreciate the reverse operations for altering the assembly 10 from its usable position to its storage/shipment position. By arranging the assembly 10 as shown on the right side of centerline 30 in FIG. 1, the entire assembly 10 may be shipped or long-term stored in a smaller container. Even when multiple assemblies are each in their usable configuration, the assemblies may be easily and reliably stacked, with the upper ring shaped edge 93 of member 37 fitting within the centrally located recess within the base 14. Moreover, the components of the assembly 10, when arranged to the right of centerline 30, provide a desired structural integrity to the assembly so that a plurality of assembled units may be easily stacked.

Those skilled in the art will appreciate that the assembly 10 may be modified for use (i.e., rotation of enclosure 18 relative to base 14) when positioned on a slanted or vertical surface. If the assembly were initially intended for use wherein the surface 15 of base 14 would be attached to a vertical wall, appropriate attachment devices might be provided with the assembly, and the bearing members 24 optionally may be changed. The remainder of the assembly may be as previously described. The arm 38 will continue to assist in the smooth withdrawal of the elongate member from the assembly 10, and will also assist in the easy recoiling of the elongate member within the chamber 12. While withdrawing the elongate member from the assembly 10, the user may walk in various directions either substantially parallel or inclined to the mounting wall.

The assembly 10 of the present invention thus provides a compact and highly efficient mechanism for both providing a storage container for a flexible elongate member, and for assisting in both the unwinding of the elongate member from the storage container and in the rewinding of the elongate member in a coil within the assembly. The device may be easily used by inexperienced personnel. The device may be arranged, if desired, in a somewhat collapsed position for storage/shipment, and may be easily rearranged in its operational position by the user. All components of the assembly 10, with the exception of the metal conduit 61 and the seals, may be fabricated from a plastic or other elastomeric material, thereby desirably reducing the weight of the assembly 10 while also avoiding corrosion problems and ensuring long use of the device. Those skilled in the art of injection molding plastic materials will appreciate that, in addition to the tapers described herein, other material surfaces may be tapered or reconfigured to assist in the injection molding process. If desired, those skilled in the art will also appreciate that a 360° swivel and quick disconnect 91 may be provided between the output end of the short hose 64 and the center support member 16, so that the assembly 10 may be easily rearranged in various positions with the hose 64 effectively attached at one end to the valve 66 and at the other end to the quick disconnect 91 mounted on the assembly 10, thereby minimizing kinking or damaging of the hose 64.

The device of the present invention has various uses, and use with a water hose for either gardening or for supplying pressurized water to a recreational vehicle are only two suitable uses for the present invention. As previously noted, various types of flexible elongate members may be coiled within the assembly 10, and the assembly 10 will assist in the desirable uncoiling and recoiling of the elongate flexible member with minimal, if any, twisting and kinking. The assembly 10 has multiple uses in the home and office, and also in the manufacturing, building construction, fishing, marine, and recreational industries. If the elongate flexible member is not of the type which transmits fluid, vacuum, or current through the elongate flexible member, assembly 10 may be used to assist in the coiling and uncoiling operation without a supply conduit 64 to the assembly. For example, the user may remove the water hose from the assembly 10 as previously described, and place a ski rope within the chamber 12 of the assembly and transport the assembly with the ski rope therein to a ski boat. At the desired time, the ski rope may be extended by pulling the end grasped by the skier from the assembly 10, then the opposite end connected to the boat. To recoil the ski rope, a boat connection member and a portion of the ski rope are simply placed within the chamber 12. Additional ski rope may then be coiled within the chamber 12 by pushing the ski robe generally downward and toward the assembly 10, with the enclosure 18 rotating relative to the stationary base 14 as described herein. If the flexible member lacks sufficient rigidity so that it may not be pushed by the operator to cause rotation of the member 42 about the base 14, the user may engage and rotate the member 42 directly, thereby recoiling the flexible member within the assembly.

It should be understood that various other modifications are contemplated by and within the scope of the present invention. For example, those skilled in the art will appreciate that neither the radially inner wall formed by 48 and 50, nor the radially outer wall formed by 39 and 48, nor the enclosure base 41, need to be solid and continuous members. These members thus may have gaps therein or may be formed from spaced bars or other stop members to achieve the containing purpose described herein. The arm 38 may be pivotably connected to the member 37, or may be selectively attachable to, and detachable from, the member 37. The assembly 10 may be positioned by the operator at a desired height on a suitable supporting object, and need not be at ground level when in use. The elongate flexible member may be coiled within and uncoiled from the assembly even if member 55 is removed from member 42. The assembly may be fabricated in multiple sizes for storing flexible elongate members having various diameters and lengths. Portions of the assembly may be manufactured from a clear plastic, so that a hose within the assembly may be more easily viewed by the operator. The assembly is relatively inexpensive, and long life can be achieved by using low cost plastic material. The invention, accordingly, is not limited to the particular apparatus and the methods discussed herein, since the foregoing disclosure and description of the invention are illustrative and explanatory. Various changes in the depicted structure as well as the exemplary methods disclosed herein may thus be made without departing from the present invention.

What is claimed is:

1. A method of unwinding a coiled flexible elongate member and rewinding the flexible elongate member in a coil, comprising:

providing a base;

rotatably mounting an enclosure on the base, the enclosure having an annular cavity therein for receiving the flexible elongate member;

securing an arm to the base such that the arm extends across an opening in the annular cavity for preventing the coiled flexible elongate member from unintentionally coming out of the receiving cavity;

pulling an end of the flexible elongate member to rotate the enclosure relative to the base and the arm in a first direction, thereby withdrawing a selected length of the flexible elongate member from the receiving cavity; and pushing the flexible elongate member toward the receiving cavity to rotate the enclosure relative to the base and the arm in an opposing second direction, thereby coiling a selected length of the flexible elongate member within the receiving cavity.

2. The method as defined in claim 1, further comprising:

removing an upper portion of a radially outward enclosing member of the enclosure from a lower portion of the radially outward enclosing member of the enclosure; and thereafter removing the coiled flexible elongate member from the annular cavity.

3. The method as defined in claim 1, further comprising:

structurally separating an upper portion of a radially inward enclosing member of the enclosure from a lower portion of the radially inward enclosing member; and securing the upper portion of the radially inward enclosing member to the lower portion of the radially inward enclosing member.

4. The method as defined in claim 1, further comprising:

securing a center support member to the base;

fluidly interconnecting a fluid source to the center support member; and transmitting fluid through the center support member to the flexible elongate member coiled within the receiving cavity.

5. The method as defined in claim 4, further comprising:

providing a fluid transfer member rotatable with the enclosure relative to the base, the fluid transfer member being in sealed engagement with the center support member and having a flow path therein for fluid communication between a fluid outlet in the center support member and an inlet end of the flexible elongate member.

6. The method as defined in claim 1, further comprising:

securing a radially inwardly directed plate to an upper portion of the radially outward enclosing member; and maintaining a spacing between a radially inner surface of the plate and a radially outer surface of the arm of less than a nominal diameter of the flexible elongate member.

7. A reel assembly for a coiled flexible elongate hose, comprising:

a base;

a hose enclosure rotatably mounted relative to the base, the hose enclosure including a radially outward enclosing member, a radially inward enclosing member, and an enclosure support member for supporting the coiled flexible elongate member the hose enclosure defining a hose receiving cavity within the hose enclosure for receiving and containing the flexible elongate hose;

one or more bearing members for facilitating rotation of the hose enclosure relative to the base;

a center support member secured to the base and having a fluid inlet and a fluid outlet for fluid communication with an inlet end of the coiled flexible elongate hose within the hose receiving cavity; and an arm member secured to the center support member and extending radially outward to cooperate with the upper radially outward enclosing member to prohibit the coiled hose from unintentionally coming out of the hose receiving cavity.

8. The reel assembly as defined in claim 7, wherein the radially outward enclosing member comprises a substantially sleeve shaped wall.

9. The reel assembly as defined in claim 8, wherein the radially inward enclosing member comprises a substantially sleeve shaped wall.

10. The reel assembly as defined in claim 7, further comprising:

a fluid transfer member rotatably mounted on the center support member for rotation with the hose enclosure relative to the base, the fluid transfer member being in sealed engagement with center support member and having a flow path therein for fluid communication between the fluid outlet in the center support member and the inlet end of the coiled flexible elongate hose within the hose receiving cavity.

11. The reel assembly as defined in claim 10, further comprising:

a rigid conduit for interconnecting the inlet end of the coiled flexible elongate hose within the hose receiving cavity and the fluid transfer member, the rigid conduit being in sealed engagement with the fluid transfer member and extending radially from inward of the radially inward enclosing member to outward of the radially inward enclosing member.

12. The reel assembly as defined in claim 7, further comprising:

the hose enclosure includes a radially inwardly directed plate secured to an upper portion of the radially outward enclosing member; and a spacing between a radially inner surface of the plate and a radially outer surface of the arm member is less than the hose diameter.

13. The reel assembly as defined in claim 12, wherein an upper portion of the radially outward enclosing member is detachable from a lower portion of the radially outward enclosing member and enclosure support member, such that the upper and radially outward enclosing member may be removed from the enclosure support member and the coiled hose removed from the assembly and a new coiled hose inserted in the hose receiving cavity within the assembly.

14. The reel assembly as defined in claim 1, wherein the enclosure support member has a generally U-shaped cross-sectional configuration and includes a lower portion of the radially outward enclosing member and a lower portion of the radially inward enclosing member defining an annular cavity therebetween.

15. The reel assembly as defined in claim 1, wherein an upper portion of the radially inward enclosing member is vertically movable relative to a lower portion of the radially inward enclosing member and enclosure support member for reducing the size of the assembly for storage/shipment.

16. The reel assembly as defined in claim 1, wherein the center support member includes:

an upper center support member having the arm member affixed thereto; and the upper center support member being removably secured to a lower center support member, such that the position of the arm member relative to the base may be selectively positioned in a usable configuration and in a storage/shipment configuration.

17. A reel assembly for receiving a coiled flexible elongate member, comprising:

a base;

an enclosure rotatably mounted relative to the base, the enclosure defining an annular receiving cavity therein for receiving the flexible elongate member;

a center support member secured to the base;

the enclosure including an enclosure support member for supporting the coiled member, a lower portion of an outer enclosing member fixedly secured to the enclosure support member, and a lower portion of an inner enclosing member fixedly secured to the enclosure support member; and an upper portion of a radially outer enclosing member removably securable to the lower portion of the radially outer enclosing member, and an upper portion of a radially inner enclosing member removably securable to the lower portion of the radially inner enclosing member, such that the assembly may be selectively positioned in a usable configuration and in a storage/shipment configuration.

18. The reel assembly as defined in claim 17, further comprising:

an arm member secured to the center support member and extending radially outward to cooperate with the upper radially outward support member to prohibit the coiled member from unintentionally coming out of the annular receiving cavity.

19. The reel assembly as defined in claim 17, further comprising:

the hose enclosure includes a radially inwardly directed plate secured to the upper portion of the radially outward enclosing member;

an arm member secured to the center support member and extending radially outward therefrom;

a spacing between a radially inner surface of the plate and a radially outer surface of the arm member is less than a nominal diameter of the flexible elongate member.

20. The reel assembly as defined in claim 17, wherein the upper portion of the radially inward enclosing member and the lower portion of the radially inward enclosing member include cooperating support surfaces to selectively secure the upper portion of the radially inward enclosing member to the lower portion of the radially inward enclosing member while selectively allowing the upper portion of the radially inward enclosing member to be lowered relative to the lower portion of the radially inward enclosing member.

* * * * *